US007050743B2

(12) United States Patent
Blair et al.

(10) Patent No.: US 7,050,743 B2
(45) Date of Patent: May 23, 2006

(54) SELF-REGENERATIVE XEROGRAPHIC COATINGS

(75) Inventors: Christopher D. Blair, Webster, NY (US); Thomas P. Debies, Webster, NY (US); Ken M. Cerrah, Livingston, TX (US); Anne L. Wickett, Ontario, NY (US); Kevin H. Taft, Williamson, NY (US); Kristen V. Baines, Buffalo, NY (US)

(73) Assignee: XEROX Corporation, Stamford, CT (US)

( * ) Notice: Subject to any disclaimer, the term of this patent is extended or adjusted under 35 U.S.C. 154(b) by 189 days.

(21) Appl. No.: 10/852,202

(22) Filed: May 25, 2004

(65) Prior Publication Data

US 2005/0265750 A1 Dec. 1, 2005

(51) Int. Cl.
*G03G 15/02* (2006.01)

(52) U.S. Cl. ..... 399/170; 250/324; 361/225; 430/902

(58) Field of Classification Search ..... 399/170, 399/171, 172, 173, 100, 93; 361/212, 214, 361/225, 229, 230; 250/324, 325, 326; 430/902
See application file for complete search history.

(56) References Cited

U.S. PATENT DOCUMENTS

| | | | | |
|---|---|---|---|---|
| 4,143,118 | A | 3/1979 | Laing | 423/219 |
| 4,315,837 | A | 2/1982 | Rourke et al. | 502/402 |
| 4,379,129 | A | 4/1983 | Abe | 423/219 |
| 4,388,274 | A | 6/1983 | Rourke et al. | 422/177 |
| 4,585,320 | A | 4/1986 | Altavela et al. | 250/325 |
| 4,585,322 | A | 4/1986 | Reale | 250/325 |
| 4,646,196 | A | 2/1987 | Reale | 361/230 |
| 4,680,040 | A | 7/1987 | Gooray et al. | 96/152 |
| 4,792,680 | A | 12/1988 | Lang et al. | 250/325 |
| 4,837,658 | A | 6/1989 | Reale | 361/230 |
| 4,853,735 | A | 8/1989 | Kodama et al. | 399/93 |
| 4,920,266 | A | 4/1990 | Reale | 250/324 |
| 5,257,073 | A | 10/1993 | Gross et al. | 399/171 |
| 5,568,230 | A | 10/1996 | Reddy et al. | 399/100 |
| 5,853,941 | A | 12/1998 | Rimai et al. | 430/122 |
| 6,350,516 | B1 | 2/2002 | Weber et al. | 428/332 |

FOREIGN PATENT DOCUMENTS

| | | | |
|---|---|---|---|
| JP | 61-286863 | A * | 12/1986 |
| JP | 01-210974 | A * | 8/1989 |
| JP | 02-281274 | A * | 11/1990 |
| JP | 05-119585 | A * | 5/1993 |
| JP | 2000-356932 | A * | 12/2000 |
| JP | 2001-331021 | A * | 11/2001 |

* cited by examiner

*Primary Examiner*—Sophia S. Chen
(74) *Attorney, Agent, or Firm*—Oliff & Berridge, PLC

(57) ABSTRACT

The invention is directed to self-regenerative, polymeric coatings and methods of using the coatings in xerography to increase the life and effectiveness of catalytic surfaces, such as, for example, charging device surfaces, by neutralizing ozone and nitrogen oxide species.

13 Claims, 11 Drawing Sheets

SELF-REGENERATIVE XEROGRAPHIC COATINGS

BACKGROUND OF THE INVENTION

1. Field of Invention

The invention is directed to self-regenerative, polymeric coatings and methods of using the coatings in xerography to increase the life and effectiveness of catalytic surfaces, such as, for example, charging device surfaces, by neutralizing ozone and nitrogen oxide species.

2. Description of Related Art

In electrophotographic printing, also known as electrophotography or xerography, a photoreceptor containing a photoconductive insulating layer on a conductive layer is imaged by first uniformly electrostatically charging its surface. The photoreceptor is then exposed to a pattern of activating electromagnetic radiation, such as light or a scanning laser beam. The radiation selectively dissipates the charge in the illuminated areas of the photoconductive insulating layer while leaving behind an electrostatic latent image in the non-illuminated areas. This electrostatic latent image may then be developed to form a visible image by depositing finely divided toner particles on the surface of the photoconductive insulating layer. The resulting visible image may then be transferred from the photoconductor to a support, such as a transparency or paper. This imaging process may be repeated many times.

The charging device uses high voltages to create a corona (a collection of ions (charged atoms or molecules) in a local area). In most cases, the corona is influenced to move towards a desired target by the opposite charge on a screen or grid type device. Generally, charging devices require a high voltage of about 5,000 volts to about 8,000 volts to produce a corona spray that imparts the electrostatic charge to the surface of the photoreceptor.

Charging devices are known as corotrons, dicorotrons, or scorotrons. Corotrons are simply bare wires. A high DC potential is placed on the corotron to create the corona. To charge photoreceptors to a positive voltage, a large positive DC voltage is placed on the corotron wire. To charge negatively, a negative potential is placed on the corotron wire. Dicorotrons are also wire devices. In dicorotrons, the wire is coated with a thick film of dielectric glass. Dicorotrons have an alternating voltage placed on the wires to create both positive and negative ions. A screen or shield with a DC bias directs the dicorotron charge towards the photoreceptor. A positive bias on the shield allows the photoreceptor to be charged positively. A negative bias on the shield allows the photoreceptor to be charged negatively. Dicorotrons often contain dicorotron shields made of aluminum coated with dispersed aqueous graphite (DAG) to generate the high voltage required to charge the photoreceptor. The aluminum material comprising a first layer of the dicorotron shield and the DAG coating comprising a second layer of the dicorotron shield combine to form a shield for containing the high voltage generated by the dicorotron and for directing the charge to the photoreceptor.

The final form of charging device is a scorotron. The scorotron can come in many configurations, such as a pin array, which is a concentration of jagged pins. The corona is created around the tips of the pins by a large negative DC charge. The corona is actually created by the pins by stripping electrons from the surrounding air molecules, thus creating positive ions. The charge is directed and regulated by a scorotron grid, which is generally a photoetched piece of sheet metal that has a bias placed on it.

Certain problems have been observed when using charging devices that produce a negative corona, such as the production of various noxious gases, including nitrogen species and ozone. For example, the nitrogen output from a dicorotron operated at nominal voltage is entirely $NO_2$, which is attributed to the presence of ozone in the corona atmosphere. Ozone oxidizes NO to $NO_2$ by the following reaction:

$$NO+O_3 \longrightarrow NO_2+O_2+0.2\ h\nu$$

This reaction produces one photon of light when about 20% of the oxidized $NO_2$ is in the excited state. As the molecule decays to a stable state, a photon is emitted with a peak excitation of about 1200 nm, which leads to the next reaction (and ultimately causes "parking deletions"):

$$2NO_2+H_2O \longrightarrow HNO_3+HNO_2 \text{ (Nitric+Nitrous Acid)}$$

This reaction is called acid hydrolysis. It requires outside energy to proceed, which, in the case of dicorotrons, is readily available as free energy put out by the corona.

Photoreceptors have been shown to be very sensitive to the resulting nitric acid compounds ($HNO_3$ and $HNO_2$). The nitric acid attacks certain molecules in the transport layer of the photoreceptor rendering them too conductive. This conductivity allows any developed charge on the photoreceptor to leak to the ground in the area of the attack or spread in what is sometimes (mistakenly) called lateral charge migration. (Lateral charge migration is actually a separate issue involving the deposit of conductive salts on the photoreceptor.) In the worst case, areas near the acid attack appear blank or blurred on a copy because the toner does not develop properly to the photoreceptor in those areas, thus forming parking deletions.

Parking deletions generally occur when charging devices are run for a long period of time (during a long print run) when relatively large amounts of $NO_2$ and $NO_3$ (collectively known as effluents) are built up. The effluents become adsorbed on the surface of nearby solids. When the machine is shutdown, the photoreceptor stops rotation and becomes "parked" with a small area directly adjacent to the charging device. Over a short period of time, the adsorbed effluents are released from the charging device in a process known as "outgassing." Since the photoreceptor is parked in very close proximity to the charging device, a small local area of the photoreceptor becomes damaged. The nitric and nitrous acids produced deteriorate and weaken the photoreceptor surface, which eventually results in uneven charging of the photoreceptor. Once damaged, the photoreceptor must be replaced, posing significant operating costs.

To reduce the parking deletion problem associated with negative corona charging, dispersed active graphite (DAG or electrodag) coatings have been applied to catalytic surfaces. Such coatings typically include a catalytic metal base as an active component, such as nickel, lead, copper, or zinc, or mixtures thereof, which tend to absorb or form harmless compounds with nitrogen oxide species, thus neutralizing the harmful chemicals. For example, U.S. Pat. No. 4,585,320 describes the adsorption of nitrogen oxide species using a thin layer of lead.

DAG coatings only work if the active component is exposed to the atmosphere. However, DAG coatings generally contain the active component in a nonfunctional matrix that supports the active component and adheres it to the substrate surface, but only permits the active component to interact with the atmosphere at the surface of the coating.

When the active component at the surface of the coating is depleted, the coating is no longer functional.

As an alternative to conventional DAG coatings, aluminum, chromium, titanium, stainless steel, and refractory metals, e.g., tungsten, molybdenum, etc., have been found to desorb the problem gases that cause parking deletions. For example, U.S. Pat. No. 4,585,322 describes the use of an alkali metal silicate coating capable of adsorbing and neutralizing nitrogen oxide species and U.S. Pat. No. 4,646,196 describes the use of a conductive dry film of aluminum hydroxide as a coating capable of absorbing and neutralizing nitrogen oxide species. Similarly, U.S. Pat. No. 4,920,266 discloses a corona generating device including at least one element adjacent to the corona discharge electrode capable of absorbing nitrogen oxide species generated when the electrode is energized, and capable of desorbing the nitrogen oxide species once the electrode is no longer energized. The element is coated with a thin, conductive, dry film of aluminum hydroxide containing graphite and powdered nickel.

Alternative parking deletion remedies are described in U.S. Pat. No. 5,257,073, which discloses a corona generating device wherein a control screen adjacent to the corona generating electrode regulates the charge flow. The control screen is coated with a substantially continuous layer of boron electronless nickel, which serves to extend the effective life of the device by preventing line image deletions. U.S. Pat. No. 4,792,680 discloses a scorotron screen for use in a negative corona charging device. The device includes a beryllium copper alloy, which reduces the problems associated with line image deletions.

While some success has been found using these various approaches, parking deletions continue to be a problem due to the failure of the known coatings and screens to continue to absorb or form harmless compounds with the ozone and nitrogen oxide species over time. Thus, a need exists for a xerographic machine that can operate efficiently while continuing to neutralize the hazardous gases that cause parking deletions and other printing/imaging problems.

SUMMARY OF THE INVENTION

The invention is directed to methods for increasing the life and effectiveness of catalytic surfaces, such as charging device surfaces, by neutralizing ozone and nitrogen oxide species. Such neutralization reduces the likelihood of parking deletions, image ghosting, photoreceptor cracking, doner/fuser roll filming, and other xerography-related problems.

Ozone and nitrogen oxide species neutralization occurs due to the presence of a self-regenerative coating comprising a degradable polymeric binder that supports an active catalytic component, e.g., particulate nickel. The binder breaks down as the active catalytic component on the surface is depleted, thereby exposing new, unused active catalytic component. Thus, fresh catalytic material is continually exposed and catalytic effectiveness is maintained. The erosion of the binder results in a "self-cleaning" of the surface and a regeneration of the active catalytic component.

In accordance with a further aspect of the invention, a charging device surface is coated with a substantially continuous, thin, conductive, dry film comprising powdered active component to neutralize the nitrogen oxide species when they are generated. The coating further comprises a binder, preferably, a styrene acrylate copolymer combined with a silicone oil, which permits the coating to expose fresh active component, thus providing continuous neutralization of the ozone and nitrogen oxide species. The coating protects the charging device, an electrode wire housed within the charging device assembly, and the environment surrounding the charging device from wire generated ozone and nitrogen oxide species.

In accordance with a further aspect of the invention, the invention is directed to an article comprising a charging device, e.g., a corotron, dicorotron, or scorotron assembly, coated on at least one surface with the inventive self-regenerative coating. The invention is further directed to a xerographic machine, such as, for example, a copier or a printer, comprising a negative corona charging device coated in accordance with the present invention. The self-regenerative coating could also be used on components of xerographic machines, such as, for example, photoreceptor belts and fuser rolls, that are subjected to a limited life due to the presence of hazardous gases.

In accordance with a further aspect of the invention, the invention is directed to a process comprising forming an inventive self-regenerative coating and applying the coating to at least one surface of a charging device, installing an electrode wire in the coated charging device, and thereafter using the charging device for charging in imaging processes as needed.

BRIEF DESCRIPTION OF THE DRAWINGS

FIG. 5 illustrates the feasible design region in hours for Acheson Colloids JD29080 coated aluminum panels, Egyptian Lacquers MQW-L120 coated aluminum panels, Egyptian Lacquers MQW-L244 coated aluminum panels, and titanium panels. The white region is the feasible region and indicates the design space to keep visible deletions out of the print (12% drop in Vc).

DETAILED DESCRIPTION OF PREFERRED EMBODIMENTS

Figure 1:
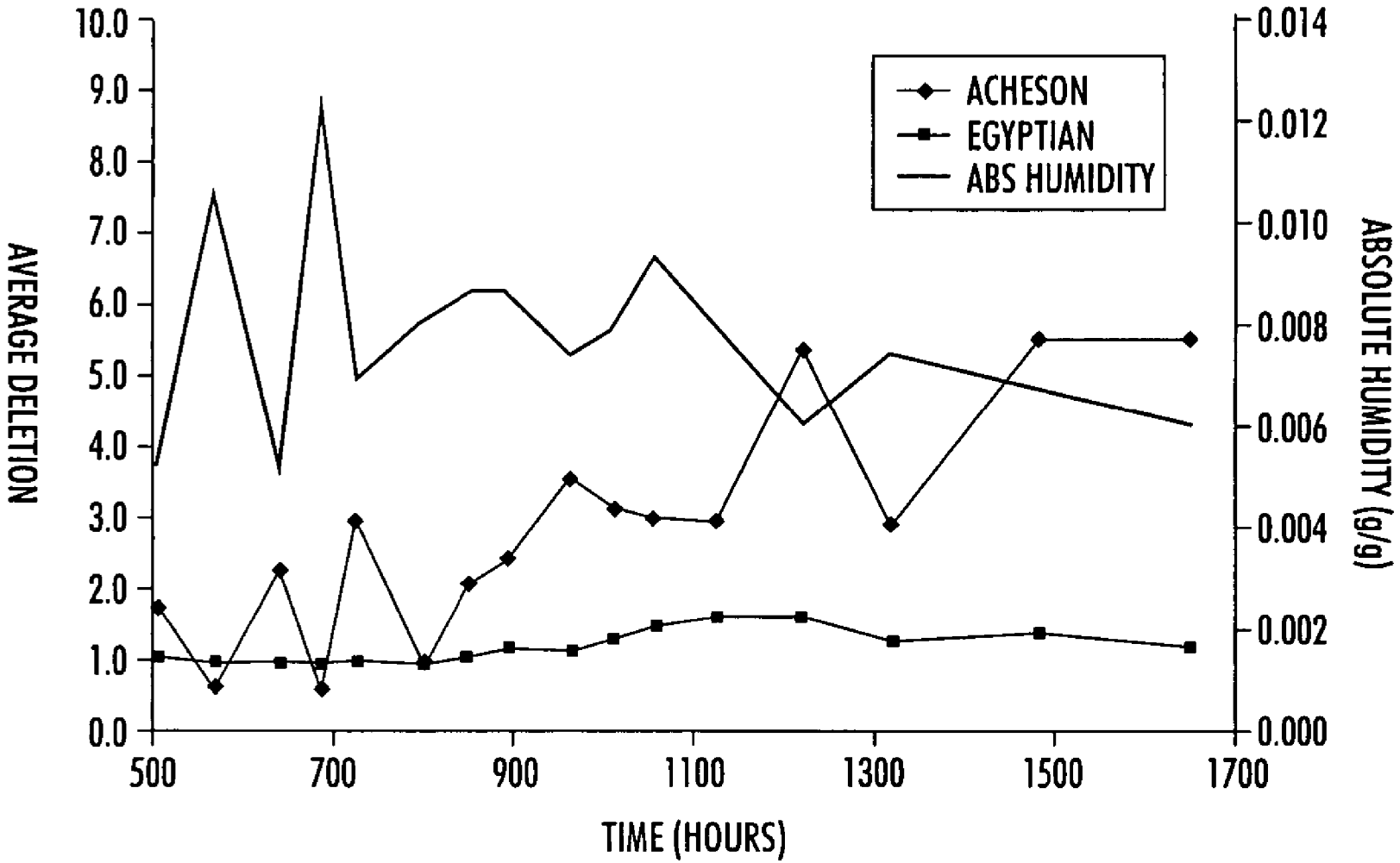
FIG. 1 is a graph comparing the average parking deletions of Egyptian Lacquers and Acheson Colloids dispersed active graphite coatings on three panels.

The inventive self-regenerative coatings place the functional, active component of the coating in a degradable binder that is susceptible to the specific type of atmosphere that the coating will be subjected to. The binder erodes in the corrosive atmosphere, thus exposing fresh, functional, active component at the surface of the coating. In xerography, the corona atmosphere is corrosive due to ozone and nitrogen oxide species that ultimately cause parking deletions and other problems as discussed above. Self-regenerative DAG coatings, whereby fresh active component, such as, for example, particulate nickel, is continuously exposed to the atmosphere as a function of time, lead to a longer substrate, e.g., charging device, life because more nickel, i.e., the nickel present throughout the bulk of the coating as opposed to the nickel present at the surface of the coating, is available to participate in the neutralization reactions.

Although particulate nickel is the preferred active component, it is prone to "bloom" whereby a build up of a nickel nitrate hexahydrate salt ($NiN_2*6H_2O$) forms on the surface of the coating. These salts are bright green and although they adhere very loosely to the coating, they can become large enough to contaminate pin arrays in scorotrons. For this reason, the coatings are most effective in machines having programs that have an automatic cleaning cycle. Alternatively, the salt build-up may be reduced by incorporating a lower nickel concentration into the coating, or the salt build-up may be eliminated by replacing the nickel with titanium, platinum, silver, or copper, or any other active component that has the ability to reduce ozone and nitrogen oxide species in a corona atmosphere.

A preferred coating formulation is water-based and comprises nickel, as the active component, in a polymeric binder comprising an acrylic copolymer, silicone oil, which may function as a defoamer, and a conductive filler or pigment. Aluminum hydroxide, alkali silicate, and a separate defoamer may also be present. The conductive filler or pigment includes, but is not limited to, graphite and amorphous carbon black. Alternatives to aluminum hydroxide include, but are not limited to, an unhydrated oxide, a hydrated oxide, aluminum hydroxide, and mixtures thereof, and sodium and/or potassium alumino silicate. Suitable alkali include, but are not limited to, $Li_2O$, $Na_2O$, and $K_2O$.

The binder comprises an acrylic copolymer, which, preferably, is a styrene acrylate copolymer. The acrylate monomer component of the styrene acrylate copolymer includes, but is not limited to, n-butyl methacrylate, isobutyl methacrylate, ethyl acrylate, n-butyl acrylate, methyl methacrylate, glycidyl methacrylate, dimethylaminoethyl methacrylate, diethylaminoethyl methacrylate, diethylaminopropyl acrylate, 2-ethylhexyl acrylate, butylacrylate-N-(ethoxymethyl) acrylamide, ethyleneglycol methacrylate, and 4-hexafluorobutyl methacrylate. It is preferable for the copolymer to contain the styrene component in an amount of about 50% by weight or more. The silicone oil component of the binder is preferably polydimethylsiloxane in a concentration of about 0.1% to about 2%. The polydimethylsiloxane may be used as a defoamer in a concentration of about 0.5 to about 1%. Alternative separate defoamers include, but are not limited to, acetylenic defoamers, such as, for example, Surfynol 104 PG50 (Air Products and Chemical Co., Allentown, Pa.) in a concentration of about 0.01% to about 1.0% of the binder.

The most preferred formulation comprises particulate nickel (about 1% to about 10%, more preferably, about 5%), styrene acrylate copolymer (about 18% to about 69%, more preferably, about 33%), polydimethylsiloxane (about 0.1% to about 2%, more preferably, about 1%), and graphite (about 10% to about 50%, more preferably, about 20%). Water is used as the solvent at a concentration of about 20% to about 60%, more preferably, about 40% or as required to make the viscosity of the formulation adequate for spray application. Additional optional components include, but are not limited to, aluminum hydroxide (about 0% to about 20%) and alkali silicate (about 0% to about 20%). Typically, the nickel powder has a particle size of from about 1.1 micrometers to about 5 micrometers and the graphite particles are from about 0.04 micrometers to about 5 micrometers in size.

A preferred, commercially available formulation is known as MQW-L120 (Egyptian Lacquers Mfg. Co., Franklin, Tenn.), which is a water-based, conductive coating prepared from technical grade materials and free of, or at least substantially free of, foreign particles and particles larger than about 5 micrometers. The coating is generally applied in about 1.0± about 0.25 ml thickness and cured on a glass substrate or other suitable material as known in the art. Another formulation known as MQW-L244 (Egyptian Lacquers Mfg. Co.) is a version of MQW-120 containing a reduced concentration of nickel, which may assist with reducing the salt build up.

Preferred physical properties of the self-regenerative coatings are set forth in Table 1.

TABLE 1

Preferred Physical Properties of Self-Regenerative Coatings

| Properties | Preferred Value |
|---|---|
| Solids Content, % By Weight | about 54 to about 58% |
| Viscosity @ 25° C. (77° F.) | #3 Zahn Cup 18–22 seconds (undiluted) |
| pH Value | about 7.5 to about 8.0 |
| Flash Point | does not flash |
| Hegman Fineness of Grind* | about 5 or less on Hegman scale |
| Adhesion | 5 B |
| Cohesion | Standard |
| Hardness | B gouge hardness |
| Abrasion Resistance | max. 40 mg loss with Taber ® abrader (Taber Industries Corp., North Tonawanda, NY) under 250 grams load and 500 cycles @ about 1 to about 1.5 ml thickness |
| Electrical Resistance of Dried Film | < about 900 ohms/sq. @ 1 ml |

*Point where the material shows a definite speckled pattern, not just specks.

Formation of the Self-Regenerative Coatings

The substantially continuous, thin, conductive, dry film-based coatings are typically formed by drying or dehydrating a liquid dispersion of the film, preferably aqueous, which has been applied as a gelatinous coating to a substrate surface. More specifically, the dry film is formed by applying a liquid dispersion of the film in one or more passes by spraying, including, but not limited to, electrostatic spraying, by brushing with a paint brush, for example, or by dip coating on a substrate surface. Preferably, the substrate surface is degreased prior to application of the film. Upon drying, at an appropriate temperature, e.g., room or elevated temperature, the liquid dispersion dries or dehydrates so as to provide a coherent film with a strong, rigid, adhesive bond to the substrate surface. The thickness of the coating layer or layers on the substrate surface, as deposited, dried or cured, can be, for example, from about 0.1 to about 100 microns, and, more preferably, from about 10 to about 100 microns, and, most preferably, about 25 microns, as a substantially uniform continuous layer without pores.

The present invention provides, in various embodiments, an article comprising a corotron, dicorotron, or scorotron assembly having the inventive self-regenerative coating applied on at least one surface thereof as described above. More specifically, the corotron, dicorotron, or scorotron assembly comprises a wire electrode, including, but not limited to, a pin array. The wire electrode can be any suitable conducting material that provides the necessary electron discharge and charging of the photoreceptor, such as, for example, tungsten or its alloys, gold, aluminum, copper, stainless steel, platinum, rhenium, molybdenum, or another highly conductive material. Corotrons, dicorotrons, and scorotrons, and their electrode components are well-known in the xerographic art. See, e.g., U.S. Pat. No. 5,853,941, the entire disclosure of which is incorporated herein by reference. The inventive, self-regenerative coatings may be applied to any xerographic charging device, or component thereof, by any suitable conventional technique, such as, for example, those set forth in U.S. Pat. Nos. 4,920,266, 4,837,658, 4,585,322, and 6,350,516, the entire disclosures of which are incorporated herein by reference.

Figure 10:
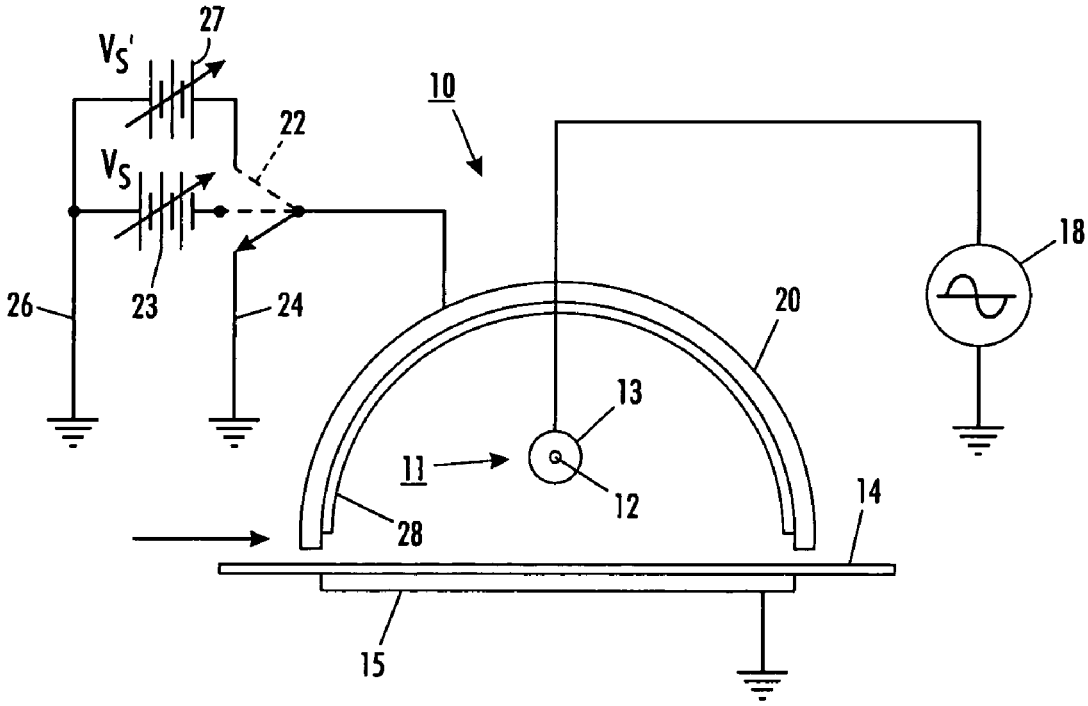
FIG. 10 is a schematic view showing a charging unit of the disclosure.

For example, a suitable charging/discharging device, such as a corotron, dicorotron or scorotron assembly, is shown in FIG. 10. Referring to FIG. 10, the corona generator or charging device (dicorotron or scorotron assembly) 10 is seen to comprise a corona discharge electrode 11 in the form of a conductive electrode wire 12 having a relatively thick coating 13 of dielectric material. A charge collecting surface 14 is shown which may be a photoconductive surface in a conventional xerographic system, such as the electrophotographic photoreceptor 1 of FIG. 11. The charge collecting surface 14 is carried on a conductive substrate 15 held at a reference potential, usually machine ground. An AC voltage source 18 is connected between the substrate 15 and the corona wire 12, the magnitude of the AC source being selected to generate a corona discharge adjacent the wire 12. A conductive shield 20, coated with a self-regenerative coating 28, is located adjacent the corona wire on the side of the wire opposite the chargeable surface.

The shield 20 has coupled thereto a switch 22 which depending on its position, permits the corona device to be operated in either a charge neutralizing mode or a charge deposition mode. With the switch 22 as shown, the shield 20 of the corona device is coupled to ground via a lead 24. In this position, no DC field is generated between the surface 14 and the shield 15 and the corona device operates to neutralize over a number of AC cycles any charge present on the surface 14. With switch 22 in either of the positions shown by dotted lines, the shield is coupled to one terminal of a DC source 23 or 27, the other terminals of the sources being coupled by lead 26 to ground thereby establish a DC field between the surface 14 and the shield 20. In this position, the corona operates to deposit a net charge onto the surface 14, the polarity and magnitude of this charge depends on the polarity and magnitude of the DC bias applied to the shield 20.

Figure 11:
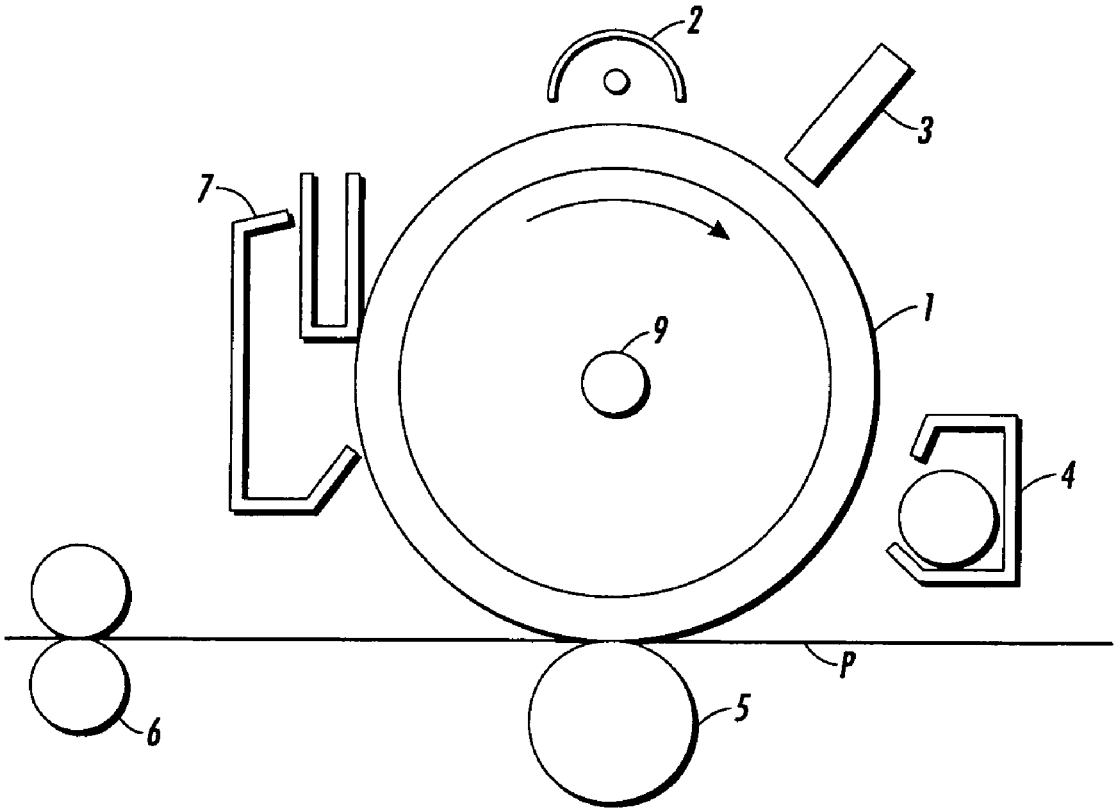
FIG. 11 is a schematic view showing an embodiment of an image

FIG. 11 is a schematic view showing an embodiment of an image forming apparatus or xerographic machine. In the apparatus shown in FIG. 11, an electrophotographic photoreceptor 1 is supported by a support 9, and rotatable at a specified rotational speed in the direction indicated by the arrow, centered on the support 9. A corotron charging device 2, an exposure device 3, a developing device 4, a transfer device 5 and a cleaning unit 7 are arranged in this order along the rotational direction of the electrophotographic photoreceptor 1. Further, this exemplary apparatus is equipped with an image fixing device 6, and a medium P to which a toner image is to be transferred is conveyed to the image fixing device 6 through the transfer device 5.

The invention will be illustrated further in the following nonlimiting Examples. The Examples are intended to be illustrative only. The invention is not intended to be limited to the materials, conditions, process parameters, and the like, recited herein. Parts and percentages are by weight unless otherwise indicated.

EXAMPLES

Example 1

Outgassing Performance/Parking Deletion Tests

Test 1

Egyptian Lacquers DAG MQW-L120 (Egyptian Lacquers Mfg. Co.) (water-based coating comprising a nickel active component in a styrene acrylate copolymer and polydimethylsiloxane binder with a surfynol defoamer, aluminum hydroxide, alkali silicate, and graphite) was compared to Acheson Colloids (Acheson Colloids Co., Port Huron, Mich.) DAG JD29080 (water-based coating comprising a nickel active component in an acrylic binder of a polyvinylacetate and polybutylacrylate blend and further comprising aluminum hydroxide, alkali silicate, and graphite), and to Acheson Colloids RW22932 DAG (water-based coating comprising a non-nickel active component in an acrylic binder of a polyacrylic acid and polyacrylamide blend and further comprising aluminum hydroxide, sodium silicate, and graphite).

The Egyptian Lacquers and Acheson Colloids materials were coated onto substrates of beryllium copper (BeCu), aluminum (Al), and 400 series stainless steel panels. The panels were aged for 1650 cumulative hours (11.8 million prints at 120 prints per minute (ppm)) next to dicorotrons that created a corona atmosphere. The dicorotrons were operated at 6 kV and 4 kHz and periodically tested for "outgassing performance" by placing an aged, coated panel on top of a strip of photoreceptor. The resulting damage to the photoreceptor was quantified using a charge acceptance scanning fixture, which tested the ability of the panels to resist storing the problem gasses and later desorbing them to cause parking deletions.

Test 2

The next group of sample materials contained Acheson Colloids JD29080 coated on three panels (BeCu, Al, and stainless steel), a titanium panel, a silver-based paint (Acheson Colloids 415, a conductive electrostatic discharge paint containing mainly silver in a binder and solvent) coated on an aluminum panel, Acheson Colloids JD29080+MgO coated on an aluminum panel, and a bare stainless steel panel. The panels were aged, the dicorotrons were operated, the photoreceptor damage was quantified as above.

Test 3

The next group of sample materials contained a Teflon® (E.I. DuPont DeNemours & Co., Wilmington, Del.) coated aluminum panel, a carbon black plus moleculite coated aluminum panel, a carbon black coated aluminum panel, a titanium panel, a beryllium copper panel, a gold sputter coated aluminum panel, and an Egyptian Lacquers MQW-L244 coated aluminum panel. The panels were aged, the dicorotrons were operated, the photoreceptor damage was quantified as above.

Results

In Test 1, the Acheson Colloids DAGs began to fail after approximately 1100–1200 hours, whereas the Egyptian Lacquers DAG continued to perform causing little or no parking deletions after approximately 1500 hours. See FIG. 1 (graph comparing the performances of the Acheson Colloids DAGs and the Egyptian Lacquers DAG), wherein higher deletion numbers indicate more damage to the photoreceptor. As can be seen from FIG. 1, the best material was the Egyptian Lacquers MQW-L120 coating. The type of panel material did not statistically alter the coating's performance.

In subsequent testing, it was determined that Egyptian Lacquers MQW-L120 caused minimal photoreceptor damage when tested in a corona atmosphere for about 5000 hours (data not shown).

Figure 2:
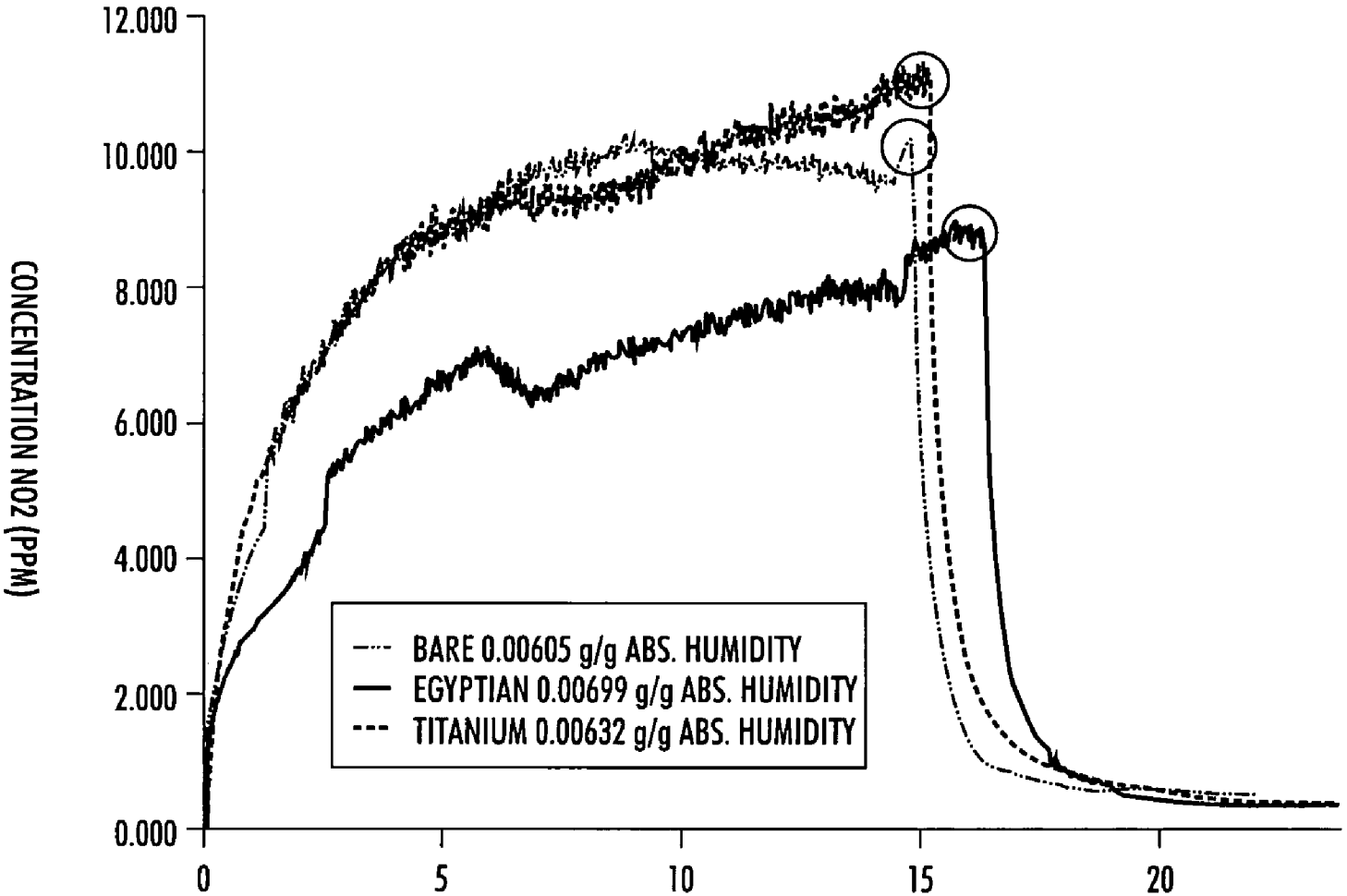
FIG. 2 is a graph comparing the sum of outgassing performances of titanium panels, Egyptian Lacquers MQW-L120 coated aluminum panels, and bare BeCu panels.
Figure 3:
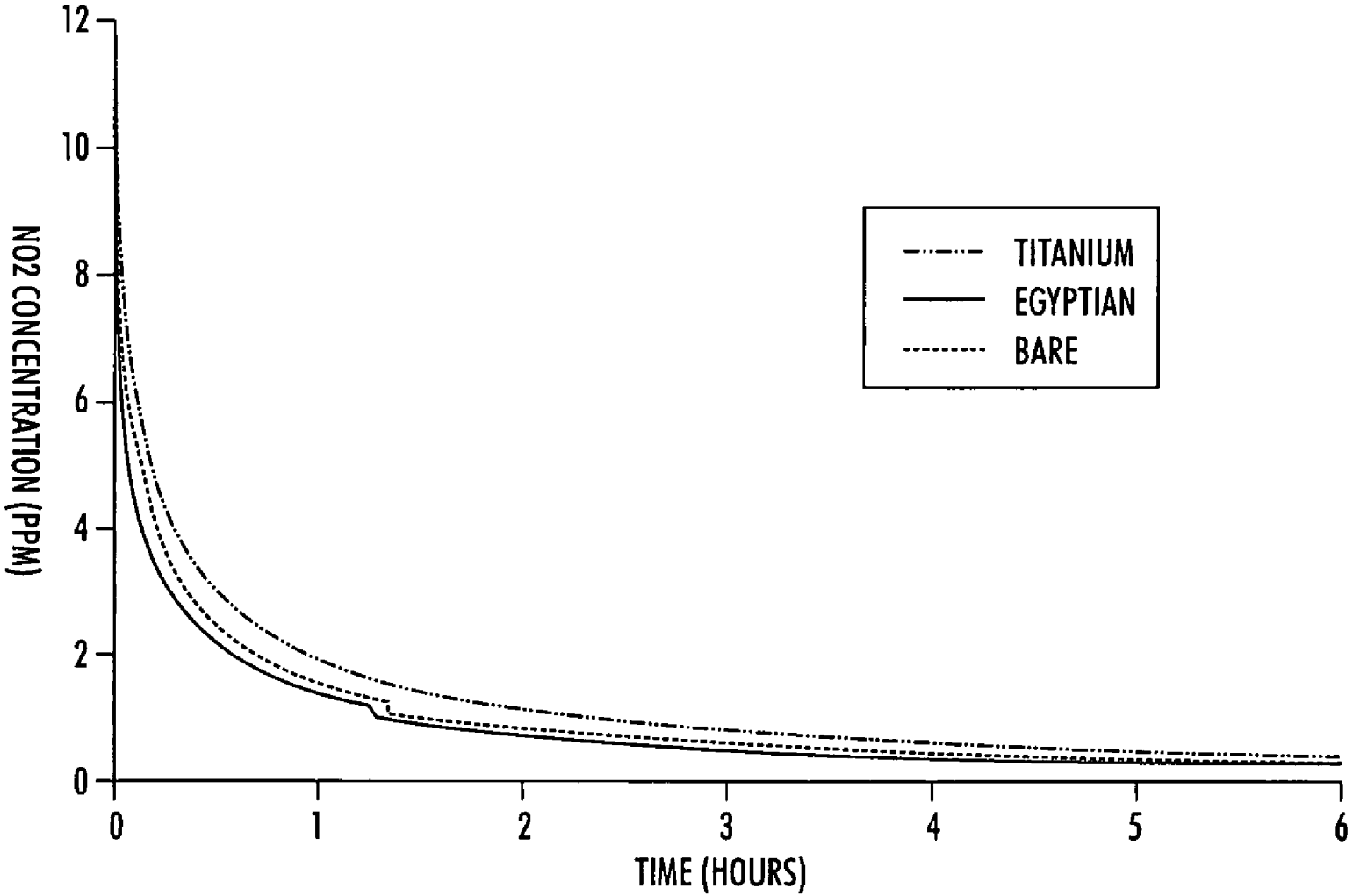
FIG. 3 is a graph displaying the sum of outgassing data for titanium panels, Egyptian Lacquers MQW-L120 coated aluminum panels, and bare BeCu panels.
Figure 6:
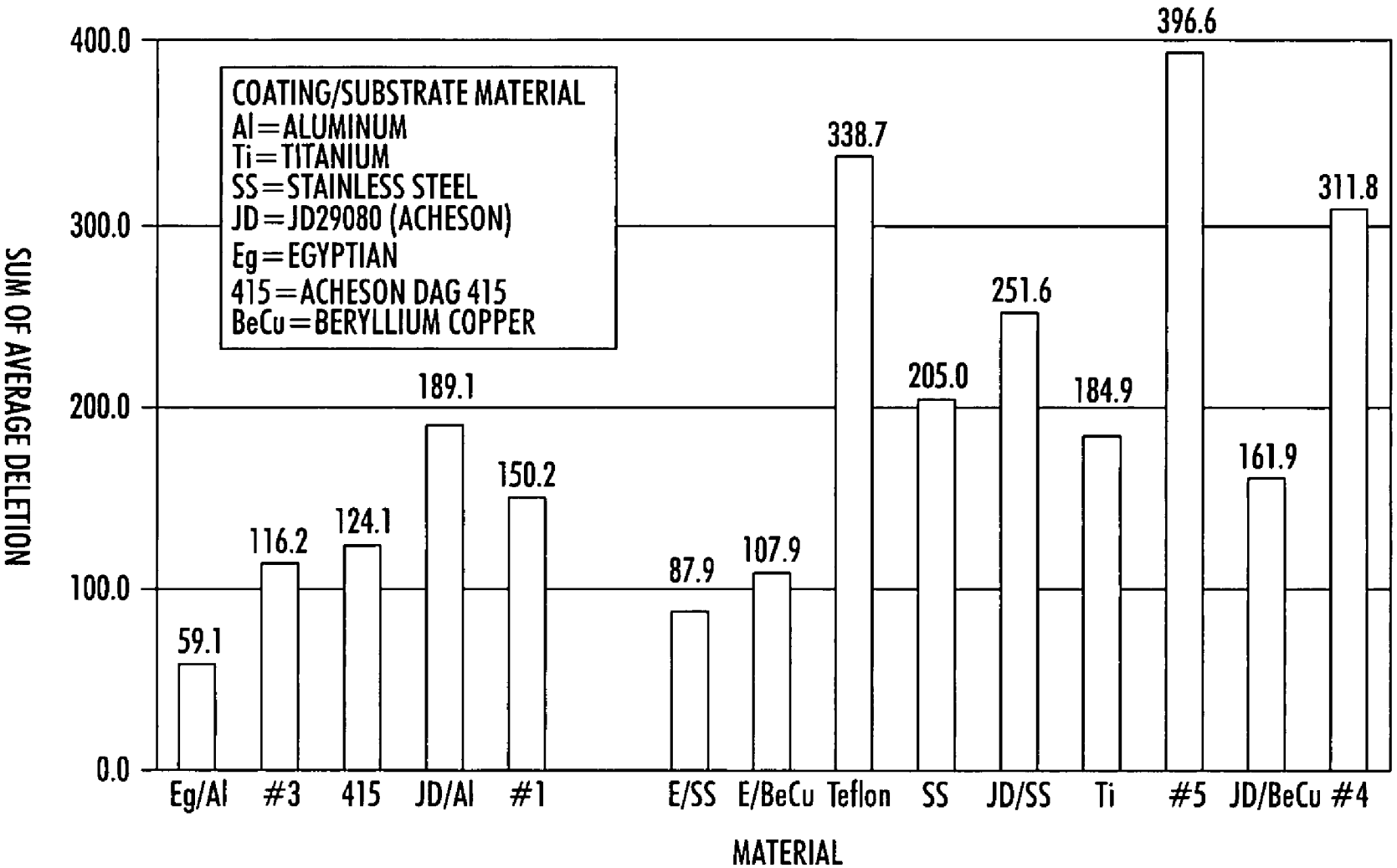
FIG. 6 is a bar graph comparing the sum of parking deletion performances of Egyptian Lacquers MQW-L120 coated aluminum panels (Eg/Al), Acheson Colloids JD29080+MgO coated aluminum panels (#3), Acheson Colloids 415 coated aluminum panels (415), Acheson Colloids JD29080 coated aluminum panels (JD/Al and replicated as #1), Egyptian Lacquers MQW-L120 coated stainless steel panels (E/SS), Egyptian Lacquers MQW-L120 coated BeCu panels (E/BeCu), Teflon® coated aluminum panels (Teflon), stainless steel panels (ss), Acheson Colloids JD29080 coated stainless steel panels (JD/SS), titanium panels (Ti), carbon black coated aluminum panels (#5), Acheson Colloids JD29080 coated BeCu panels (JD/BeCu), and carbon black plus moleculite coated aluminum panels (#4).
Figure 7:
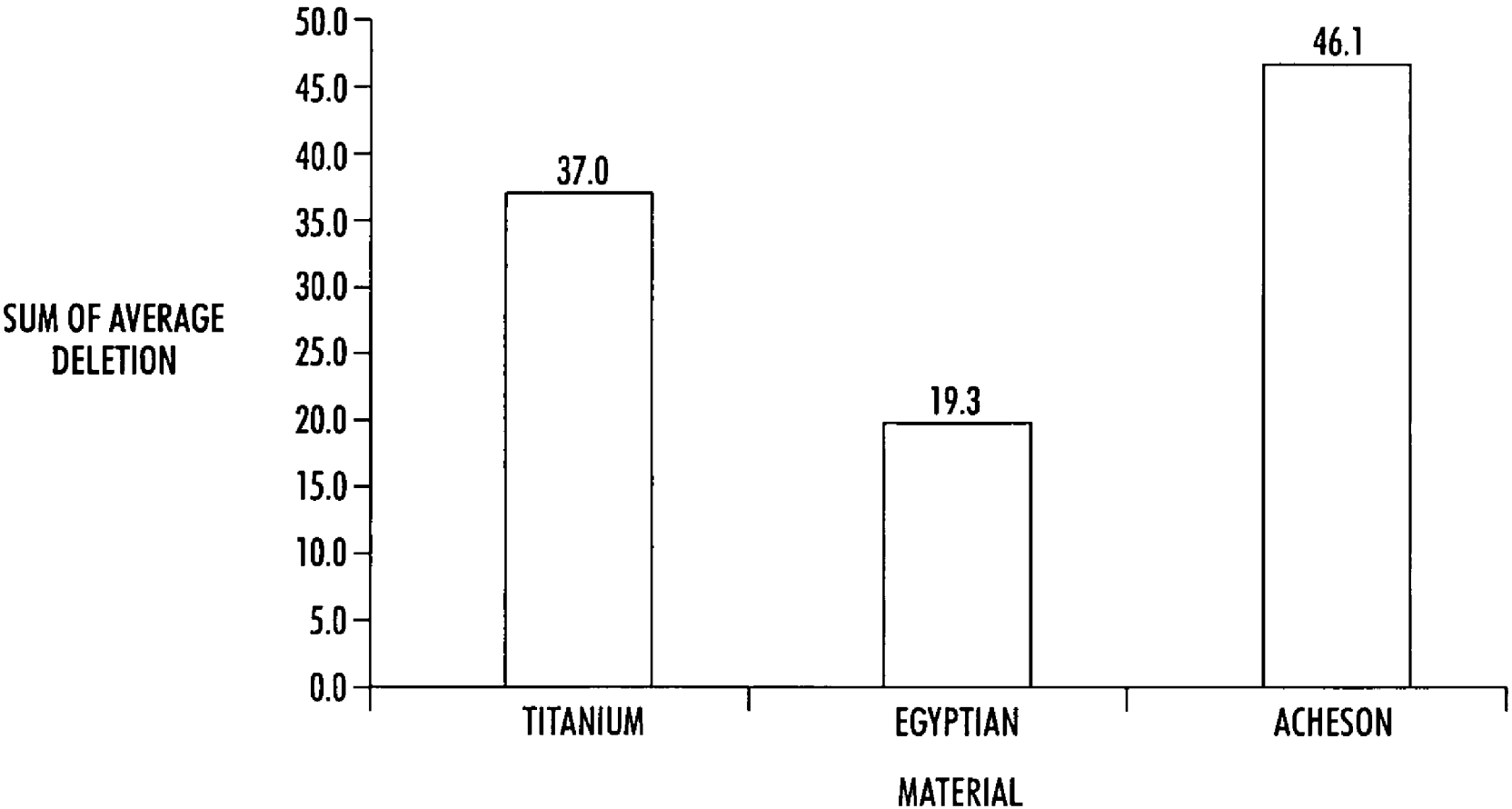
FIG. 7 is a bar graph comparing the sum of the average parking deletions (n=12) over about 1650 hours for Acheson Colloids JD29080 coated aluminum panels, Egyptian Lacquers MQW-L120 coated aluminum panels, and titanium panels.

The sum of the various results from the materials tested in Tests 1–3 are represented in FIGS. 2 and 3, wherein $NO_2$ concentration and outgassing performance, respectively, are illustrated for the titanium panels, beryllium copper panels, and Egyptian Lacquers MQW-L244 coated aluminum panels. In addition, FIG. 6 represents a comparison of the sum of the parking deletion performances of the Egyptian Lacquers MQW-L120 coated aluminum panels (Eg/Al), Acheson Colloids JD29080+MgO coated aluminum panels (#3), Acheson Colloids 415 coated aluminum panels (415), Acheson Colloids JD29080 coated aluminum panels (JD/Al and #1), Egyptian Lacquers MQW-L120 coated stainless steel panels (E/SS), Egyptian Lacquers MQW-L120 coated BeCu panels (E/BeCu), Teflon® coated aluminum panels (Teflon), stainless steel panels (ss), Acheson Colloids JD29080 coated stainless steel panels (JD/SS), titanium panels (Ti), carbon black coated aluminum panels (#5), Acheson Colloids JD29080 coated BeCu panels (JD/BeCu), and carbon black plus moleculite coated aluminum panels (#4). Finally, FIG. 7 compares the sum of the average parking deletions (n=12) over about 1650 hours for Acheson Colloids JD29080 coated aluminum panels, Egyptian Lacquers MQW-L120 coated aluminum panels, and titanium panels. All data indicate that Egyptian Lacquers MQW-L120 is the most effective coating on any substrate material.

Figure 4:
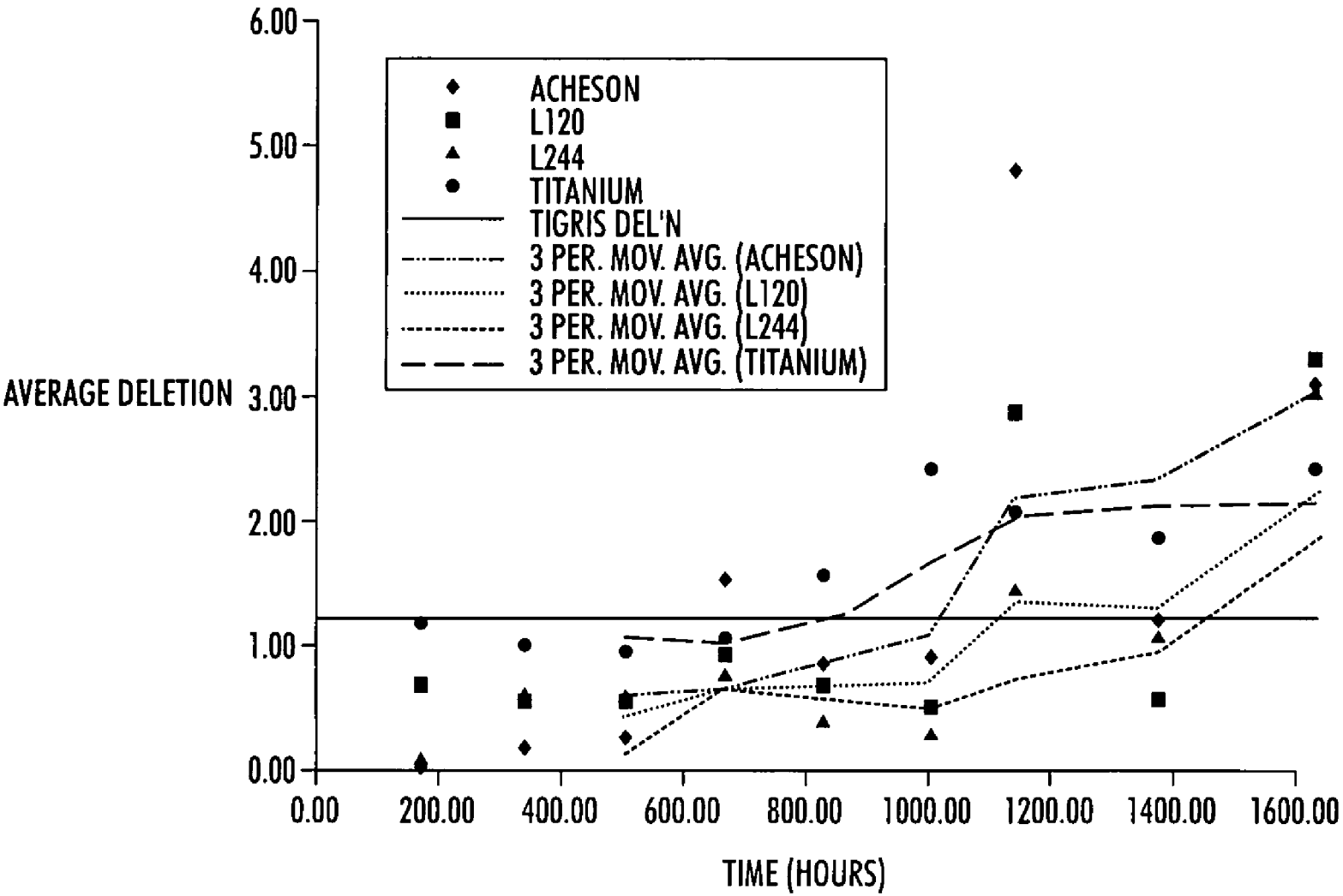
FIG. 4 is a graph illustrating average parking deletions for Acheson Colloids JD29080 coated aluminum panels, Egyptian Lacquers MQW-L120 coated aluminum panels, Egyptian Lacquers MQW-L244 coated aluminum panels, and titanium panels. Each data point contains the average deletion for twelve panels. A three period moving average trend line is used to smooth the data.

FIG. 4 illustrates outgassing performances for the Acheson Colloids JD29080 coated, Egyptian Lacquers MQW-L120 coated, and Egyptian Lacquers MQW-L244 coated aluminum panels and the titanium panel. Each data point contains the average deletion for twelve panels having the same coating for the time indicated. A three period moving average trend line was used to smooth the data. The oscillations in the data are likely caused by variability in the atmospheric conditions (humidity caused higher readings, light exposure to the photoreceptor caused lower readings), variability in the different photoreceptors used, and variability associated with the test itself due to operator error and the subjective interpretation of data.

Figure 5:
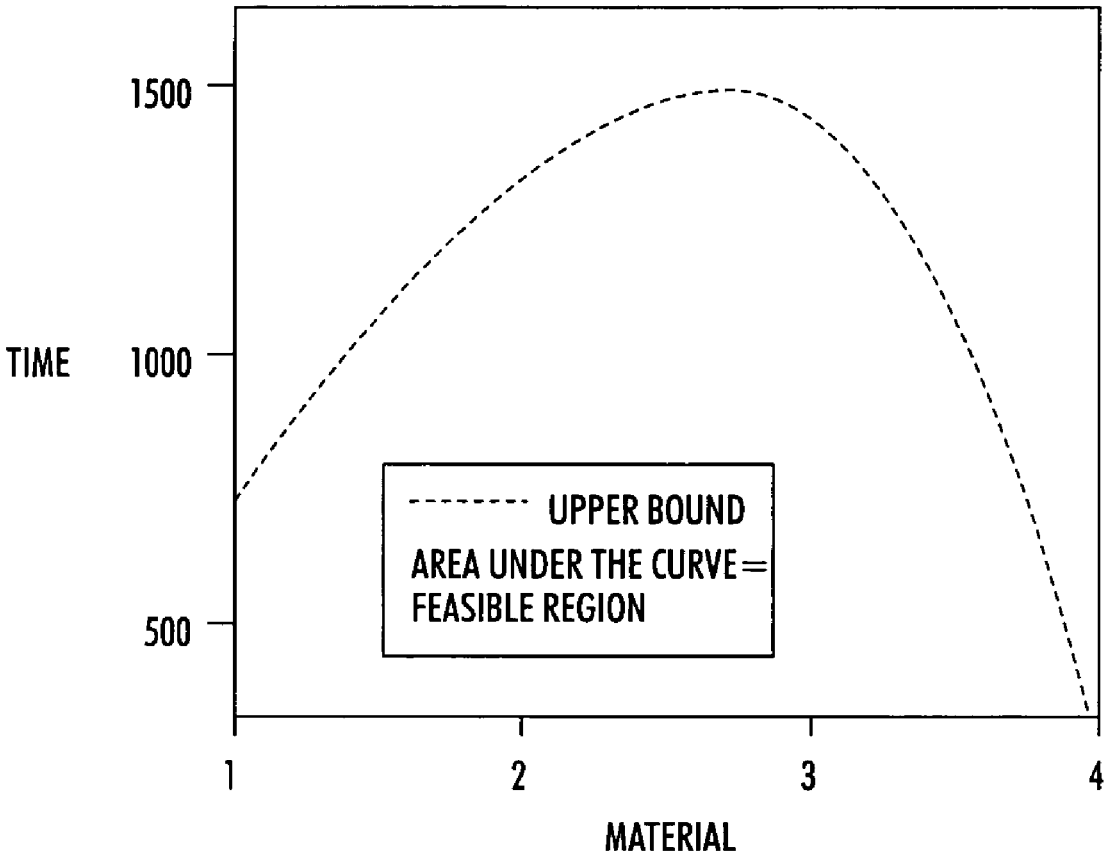
FIG. 5 is a minitab graph of the data of FIG. 4.

The data appear to indicate that all samples performed similarly, however, MQW-L120 and MQW-L244 had the best performance as noted in FIG. 5. FIG. 5 is a minitab graph (contour plot of the data in FIG. 4) illustrating the feasible design region in hours for the four samples. The region under the curve indicates the design space to keep visible deletions out of print (12% drop in Vc (voltage that the receptor is charged to)). The graph shows that the JD29080 coating can be used for about 750 hours without a visible deletion. However, MQW-L120 and MQW-L244 can be used for about 1500 hours. Titanium is useful for less than about 500 hours. The graph is based on 120 data points.

Example 2

Nitric Acid Reduction

The Egyptian Lacquers MQW-L120 coating on an aluminum panel was further tested in a sealed chamber for its effect on nitric oxide concentrations. It was determined using a charging device that such concentrations were reduced by approximately 30% in the sample test chamber. Nitric oxide concentration was measured with a NOx meter (Ecophysics, Ann Arbor, Mich.).

Figure 8:
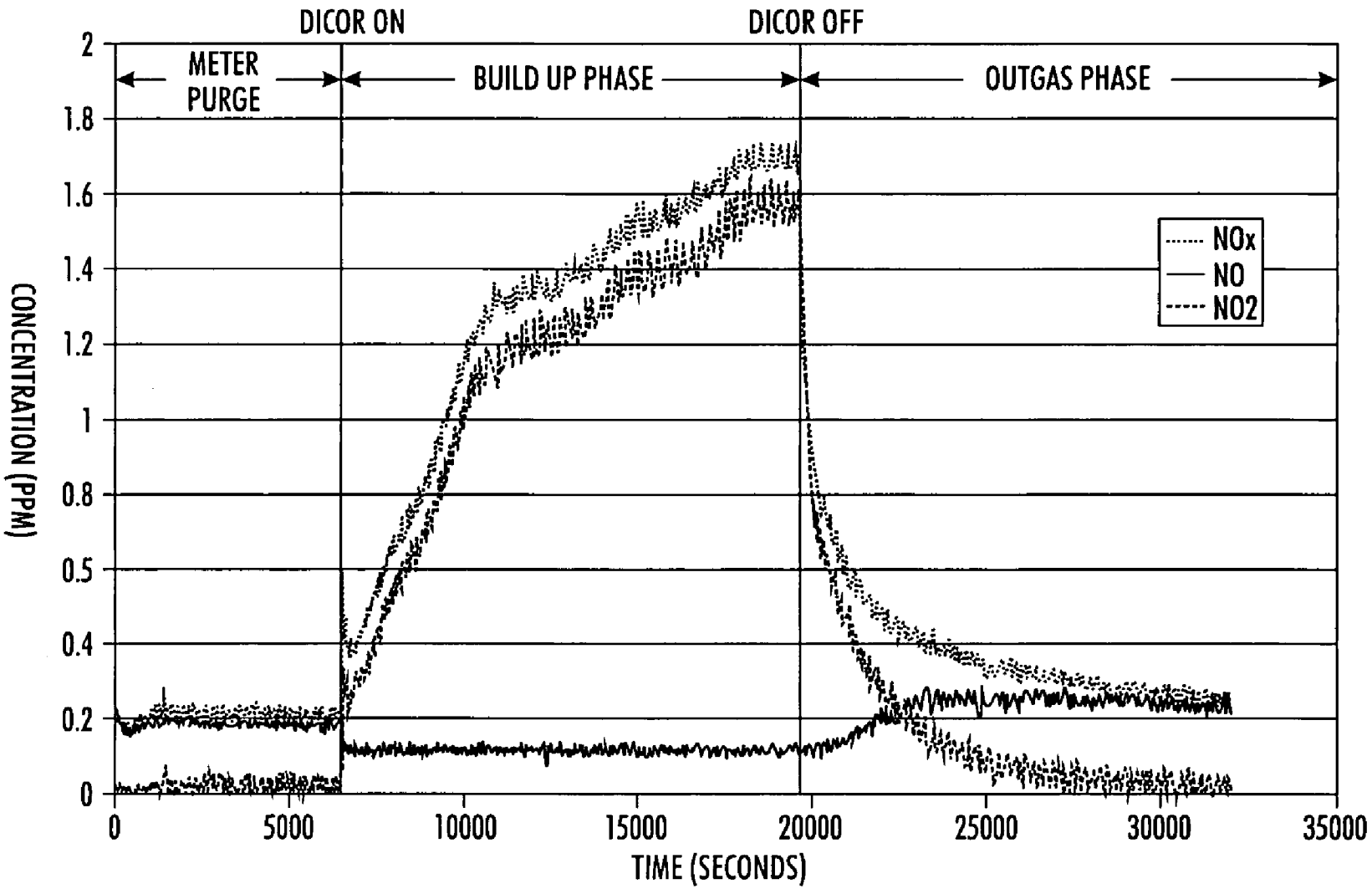
FIG. 8 is a graph illustrating the distinct phases of an outgas procedure in a dicorotron.
Figure 9:
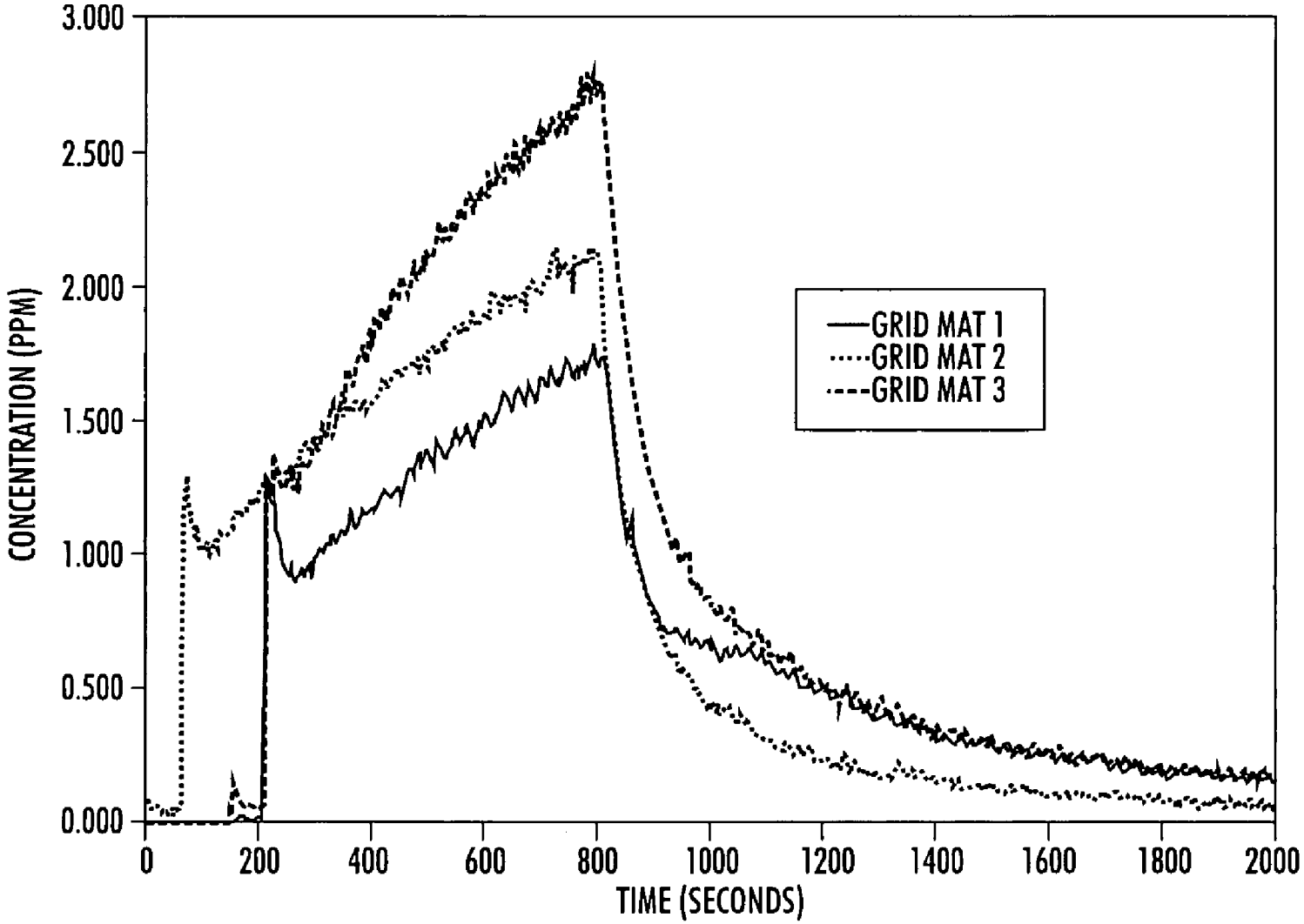
FIG. 9 is a graph illustrating the distinct phases of outgas procedures run in a scorotron using three different grid materials (Mat 1=Egyptian Lacquers MQW-L120 coated aluminum panel, Mat 2=bare BeCu panel, Mat 3=Acheson Colloids JD29080 coated aluminum panel).

The operation of the charging device (either pin array negative scorotron or AC dicorotron) produced distinct phases as summarized in FIGS. 8 and 9. As illustrated in FIG. 8, during the initial phase, the NOx meter was run with the dicorotron charging device off. The measured levels are from background NOx concentration found in the environment (ambient NOx is mostly of the NO variety). The build up phase started at the time that the charging device was turned on. At first, the $NO_2$ build up was extremely rapid, then the concentration dropped. The build up then proceeded through a somewhat linear phase before beginning to level off to a steady state. The steady state concentration depended upon the box volume, the sampling flow rate, the integrity of the box (air tightness), and the wire voltage. Switching off the charging device triggered the outgassing phase. At first, the curve decreased very rapidly, but then began to level out back to ambient conditions. One important observation is that NOx is very persistent. It may take days for the glass-lined boxes to return to ambient concentrations. The outgassing phase is the most significant for parking deletions. To reduce the probability of parking deletions, panel materials and/or coatings are used that outgas back to ambient as quickly as possible so that the gasses are not allowed to interact with the photoreceptor.

DC negative scorotrons appear to have an output very similar to dicorotrons. However, it is believed the output of a scorotron is far lower than that of a dicorotron. FIG. 9 summarizes various scorotron runs using three different grid materials—Egyptian Lacquers MQW-L120 coated aluminum panel (Mat 1), bare BeCu panel (Mat 2), and Acheson Colloids JD29080 coated aluminum panel (Mat 3). Although the absolute concentrations are higher in the scorotron graph than in the dicorotron graph, they cannot be directly compared because the sampling chambers are of different volumes. It is difficult to quantify the volume difference because of the complex shape of the charging device assemblies. However, one could calculate NOx production rates in μg/min. to compare results.

While the invention has been described with reference to the specific embodiments, it will be apparent to those skilled in the art that many alternatives, modifications, and variations may be made. It is intended to embrace such alternatives, modifications, and variations as may fall within the spirit and scope of the appended claims.

All the patents, publications, and articles referred to herein are hereby incorporated by reference in their entirety.

What is claimed is:

1. An article comprising a charging device coated on at least one surface with a self-regenerative coating, wherein the coating comprises an active component capable of neutralizing ozone and nitrogen oxide species, a conductive filler or pigment, a binder surrounding at least the active component, silicone oil, and water, wherein the binder comprises an acrylate styrene copolymer.

2. An article in accordance with claim 1, wherein the silicone oil is polydimethylsiloxane.

3. An article in accordance with claim 1, wherein the active component is selected from the group consisting of nickel, titanium, platinum, silver, copper, zinc, tin, lead, gold, zirconium, and rhenium.

4. An article in accordance with claim 3, wherein the active component is nickel.

5. An article in accordance with claim 1, wherein the conductive filler or pigment is amorphous carbon black or graphite.

6. An article in accordance with claim 5, wherein the conductive filler or pigment is graphite.

7. An article in accordance with claim 1, wherein the coating protects the charging device, an electrode wire housed within the charging device, and the environment surrounding the charging device from ozone and nitrogen oxide species.

8. An article in accordance with claim 7, wherein the charging device is a dicorotron, scorotron, or corotron.

9. An article in accordance with claim 1, wherein the coating comprises:

nickel in a concentration of from about 1 to about 10% based on the total weight of the coating;

graphite in a concentration of from about 10 to about 50% based on the total weight of the coating; and a binder comprising an acrylate styrene copolymer and polydimethylsiloxane in a concentration of from about 18.1 to about 71% based on the total weight of the coating.

10. An article in accordance with claim 9, wherein the thickness of the coating is about 10 to about 100 microns.

11. A process for neutralizing ozone and nitrogen oxide species, comprising:

a) forming the self-regenerative coating of claim 9;

b) applying the coating to a dicorotron or scorotron assembly; and c) installing an electrode wire in the coated dicorotron or scorotron assembly, wherein the nickel component of the coating is capable of neutralizing ozone and nitrogen oxide species.

12. A process in accordance with claim 11, further comprising:

d) using the electrode wire containing coated dicorotron or scorotron assembly for charging in imaging process.

13. A xerographic machine comprising a charging device in accordance with claim 1, wherein the charging device is a negative corona charging device.

* * * * *